US010704862B2

(12) United States Patent
Chung

(10) Patent No.: US 10,704,862 B2
(45) Date of Patent: Jul. 7, 2020

(54) NEXT GENERATION MACHINE GUN SIGHT (NEXGEN MGS)

(71) Applicant: INTERNATIONAL TRADE AND TECHNOLOGIES, INC., McLean, VA (US)

(72) Inventor: Sung Giu Chung, McLean, VA (US)

(73) Assignee: INTERNATIONAL TRADE AND TECHNOLOGIES, INC., McLean, VA (US)

( * ) Notice: Subject to any disclaimer, the term of this patent is extended or adjusted under 35 U.S.C. 154(b) by 0 days.

(21) Appl. No.: 16/165,669

(22) Filed: Oct. 19, 2018

(65) Prior Publication Data

US 2019/0145733 A1 May 16, 2019

Related U.S. Application Data

(60) Provisional application No. 62/585,928, filed on Nov. 14, 2017.

(51) Int. Cl.

| | |
|---|---|
| ***F41G 1/30*** | (2006.01) |
| ***F41G 3/08*** | (2006.01) |
| ***F41G 3/06*** | (2006.01) |
| ***F41G 11/00*** | (2006.01) |

(52) U.S. Cl.

CPC ..... *F41G 1/30* (2013.01); *F41G 3/065* (2013.01); *F41G 3/08* (2013.01); *F41G 11/003* (2013.01)

(58) Field of Classification Search

CPC ..... F41G 1/30; F41G 3/08; F41G 3/065

See application file for complete search history.

(56) References Cited

U.S. PATENT DOCUMENTS

| | | | | |
|---|---|---|---|---|
| 7,225,578 | B2 * | 6/2007 | Tai | F41G 1/30 33/334 |
| 7,484,856 | B1 * | 2/2009 | Newhall | F41G 1/04 359/511 |
| 8,186,093 | B1 | 5/2012 | Chung | |
| 8,296,991 | B1 | 10/2012 | Chung | |
| 8,408,460 | B2 * | 4/2013 | Schneider | F41G 1/467 235/404 |
| 8,505,231 | B2 | 8/2013 | Chung | |

(Continued)

OTHER PUBLICATIONS

"5x Tactical Magnifier", http://sightmark.com/product.php?item=284 (Year: 2016).*

*Primary Examiner* — Joshua T Semick

(74) *Attorney, Agent, or Firm* — Birch, Stewart, Kolasch & Birch, LLP

(57) ABSTRACT

A Next Generation Machinegun Sight (NexGen MGS) with a modular and universal design is discussed, whereby the NexGen MGS includes a lens body in a detachable manner; a display module disposed on a main body; a built in or standalone LRF connected into a ballistic computer to provide a disturbed reticle; a control switch or a remote control for fast and safe system operation without sacrificing combat grip; and multiple mounting rails disposed on the main body to accommodate the LRF, magnifiers, cameras and other equipment. The NexGen MGS is a reflex sight with a disturbed reticle that provides a range-adjusted aim-point based on ballistics equations embedded within the MGS using a latest high resolution and sunlight readable display and laser range technologies.

23 Claims, 13 Drawing Sheets

(56) References Cited

U.S. PATENT DOCUMENTS

| | | | | |
|---|---|---|---|---|
| 8,959,824 | B2 * | 2/2015 | Sammut | F41G 1/38 42/122 |
| 9,057,583 | B2 * | 6/2015 | Matthews | F41G 1/30 |
| 9,057,584 | B2 * | 6/2015 | Chung | F41G 1/16 |
| 9,518,804 | B2 * | 12/2016 | Hamilton | F41G 1/473 |
| 9,766,040 | B2 * | 9/2017 | Roman | F41G 3/06 |
| 10,180,565 | B2 * | 1/2019 | Havens | G02B 23/04 |
| 10,330,439 | B2 * | 6/2019 | Jeung | F41G 1/30 |
| 2005/0268521 | A1 * | 12/2005 | Cox | F41G 1/38 42/130 |
| 2013/0008072 | A1 | 1/2013 | Chung | |
| 2013/0333266 | A1 * | 12/2013 | Gose | F41G 1/00 42/111 |
| 2018/0172404 | A1 * | 6/2018 | Kleck | F41G 1/473 |
| 2019/0056199 | A1 * | 2/2019 | Pautler | F41G 1/38 |

* cited by examiner

NexGen MGS Main Modules

NexGen MGS with Complete Modules

NEXT GENERATION MACHINE GUN SIGHT (NEXGEN MGS)

CROSS REFERENCE TO RELATED APPLICATION

This application claims the priority benefit under 35 U.S.C. § 119(e) of U.S. Provisional Application No. 62/585,928 filed on Nov. 14, 2017, the disclosure of which is incorporated herein by reference.

BACKGROUND OF THE INVENTION

Field of the Invention

Embodiments of the invention relate to a modular/universal crew served weapon (CSW) Sight with a disturbed reticle using a Laser Range Finder (LRF) that is designed and built for Machineguns, especially medium and heavy machine guns, used by armed forces, hunters, and law enforcement agencies. Using a LRF, shooters can accurately acquire a distance to the target and deliver the first round on target effectively. The Next Generation Machine Gun Sight (NexGen MGS) eliminates the need for a guesswork as it comes with a disturbed reticle that provides a range-adjusted aiming point based on ballistic equation or solution embedded within the sight. An accurate distance to the target info is provided by a LRF to a built-in ballistic computer into the sight allowing to move a reticle (for example, a red dot) to accurate position on the NexGen's large field of view lens.

Discussion of the Related Art

Iron sights are commonly used by shooters for aiming firearms such as rifles, or medium and heavy machine guns. Each iron sight requires the shooter to align a rear and front sights of a rifle along with the target, which requires trainings and shooting skills.

Dot sights were developed to offer a rapid target acquisition of both stationary and moving targets with minimal training. A sight can easily convert non-experienced shooter into a skilled marksman. A sight is also commonly known as a non-magnifying reflector (or reflex) sight that is mounted on firearms to provide the shooter an aiming indication in the form of a red dot or a red dot with a circle. Sights are designed and developed to offer shooters, such as sportsmen, hunters, policemen and soldiers the ability to acquire and engage target or targets quickly and effectively.

The NexGen MSG was developed as a true user-friendly device in the sense that a shooter is only required to aim the red dot on the target and upon pulling the trigger, a projectile will impact the point of aim.

The NexGen MGS includes the Machine Gun Sight (MGS) with a built-in Ballistic Computer, a Display Module (DM), a LRF (Integrated or standalone), and other sensors such as wind sensor, inclinometer (measure tilt), thermometer and others.

The NexGen MGS was developed to improve the first round probability of hit by elimination guestwork associated with a range estimation. During a highly stressful and complex combat environment, there may be no time for guesswork or hesitation, and the NexGen MGS simplifies the shooting process. The NexGen MGS is specifically designed to convert dummy crew served weapons into smart weapons by integrating the LRF and the ballistic computer into the Machine Gun Sight (MGS). The NexGen MGS can use a standalone or a built-in laser rangefinder that measures the range and, using the user-defined ammunition ballistic characteristics or firing tables, the ballistic computer calculates a ballistic drop. The red or green dot aiming point is automatically adjusted according to the calculated Bullet Drop Compensator (BDC) to allow shooters to deliver the first round on target saving ammo and eliminating collateral damages. Every round will be on-target quickly when you eliminate guesswork.

The DM could be an Organic Light Emitting Diode (OLED) display, a liquid crystal Display (LCD) or a transparent display replacing a red light-emitting diode (LED Module) at the focus of the collimating optics to generate a light that is visible to the human eye. A visible dot or reticle remains parallel to a bore of the firearm no matter what position the human eye is in relative to the dot sight. Using a display, red dot (typically) can be moved (up, down, left, right) based on ballistic calculation. Using a DM, the NexGen MGS can project other valuable information on the lens such as a range to target, caliber type, wind speed, battery status and others.

Currently deployed CSW sights do not come with a LRF requiring shooters to estimate a distance to the target. The NexGen MGS comes with a LRF (built-in or standalone), eliminating need for a guess work. An accurate distance to the target info is provided to the built-in ballistic computer to move a reticle (typically red dot) to an accurate position on the NexGen's large field of view lens.

Even though the NexGen MGS is supplied with most popular caliber selections (such as 5.56 mm, 7.62 mm and 12.7 mm), users will be able to add other ballistic tables allowing the NexGen MGS to use special caliber weapons or special ammunitions.

A very large field of view design enables the shooter to keep both eyes open during operation to enable an unlimited field of view at any distance. The eye relief is also unlimited, which means that the shooter's eye position behind the sight does not affect how well the shooter sees the target.

Shooting with both eyes open offers the shooter enhanced situational awareness to allow the possibility to deal with multiple targets. A dot sight helps a shooter to become an effective marksman offering ability to aim accurately and quickly under any extreme or stressful conditions.

A parallax free dot sight refers to a visible dot that remains parallel to a bore of the firearm, so no matter what position the shooter's eye is in, it will remain relative to the sight allowing the shooter to engage a target or targets in stationary or moving platforms (i.e. helicopters and boats.)

The NexGen MGS is also truly a modular Universal Machinegun Sight and many of modules and components used by the Machine Gun Sight (MGS) can be used to reduce manufacturing and logistic costs.

The NexGen MGS comes with multiple rails for a quick integration of magnifiers, cameras, night vision goggles (NVGs), a LRF, and other equipment.

The NexGen MGS comes with a remote control or remote pressure pad switch for fast and safe system operation without sacrificing your combat grip.

SUMMARY OF THE INVENTION

The disclosure of U.S. Pat. Nos. 8,186,093, 8,296,991, 8,505,231, 9,057,584 B2 and US Application Publication No. 2013-0008072 A1 are incorporated by reference into the present application.

Currently, the U.S. military is facing a variety of challenges, including budget cuts, sequestration, shot-down and other financial circumstances that limits their ability to purchase latest weapon systems. Therefore, Program Managers are looking for modular design equipment so that equipment purchased can be quickly upgraded to meet any future operational needs. In addition, they are looking for equipment that requires less maintenance or easy/convenient maintenance and accurately deliver rounds on target to save money in ammunition/training. The NexGen MGS is designed to meet the current US military requirements in terms of low maintenance, ease of any future upgrade and save money in training/ammo.

The NexGen MGS is truly a universal weapon sight and is designed to save money as soldiers only need one sight for all their crew served weapons as it comes with a DM allowing to generate/project various reticles or an exact aiming point dot using a LRF and built-in ballistic solution. Typically, different sight devices are needed for different types of machineguns such as small, medium and large sight devices. An object of an embodiment of the invention is to provide one dot sight device called the NexGen MGS for various machineguns. The NexGen MGS will allow users to add their own ballistic tables to the ballistic computer.

The NexGen MGS offers a very large field of view lens that provides rapid target acquisition for both stationary and moving targets. In addition, soldiers have an option to select different size lens to match their operational requirements.

The NexGen MGS includes medium and larger lens bodies and lens covers to protect lenses from foreign objects. Due to its modular design, the lens body can be detached from the main body and allow users to install other size lens to meet their operational requirements. Due to its modular design, other lens sizes can be installed with the NexGen MGS.

Utilizing the latest technology in LRFs, an accurate distance to the target info is provided to built-in ballistic computer to move a reticle (such as a red dot) to an accurate position on the NexGen's large field of view lens. The NexGen MGS provides pin-point accuracy, which ensures that every bullet is on target to ultimately suppress enemies faster, reduce collateral damage, and conserve ammunition.

The ballistic computer is the brain of the NexGen MGS and it allows users to add various firing tables so that it can be operated with ALL crew served weapons. When the NexGen MGS is integrated with a LRF, an accurate distance to the target info is provided to the ballistic computer. A LRF eliminates the need for guesswork and the NexGen MGS's built in ballistic computer provides a range-adjusted aiming point based on ballistic equation or solution embedded within the sight.

The NexGen MGS's Display Module (DM) replaces the LED Module with a fixed MIL DOT Circle reticle with multiple hash marks. The DM eliminates the need to replace a LED module to match a caliber used. Users of the NexGen MGS with a DM will have an option to select a MIL DOT CIRCLE reticle from the main menu to match the machinegun caliber in case a LRF is neither operational nor available. The NexGen MGS comes with commonly used caliber reticles such as 5.56 mm, 7.62 mm and 12.7 mm where shooters will be able to select from the main menu to match ammo used to target and neutralize enemies with pin-point accuracy. When the NexGen MGS is operated with a LRF, there is no need to project a MIL DOT Circle reticle with multiple hash marks. Only one dot (e.g., a disturbed reticle) will be projected on the lens to eliminate confusions and guest works as the ballistic computer will provide a range-adjusted aiming point based on ballistic equation or solution embedded within the sight. In addition, the DM will allow users to generate and project other information such as range, caliber, wind, temperature and others valuable information.

For a manufacturer, the NexGen MGS modular design will reduce manufacturing costs by creating less waste of raw materials and simplifying a manufacturing process. For users, the NexGen MGS offers a low maintenance cost as any defective module can be quickly replaced eliminating the need to buy a new sight. For instance, if the lens is broken or scratched, the modular design offers an option to simply replace the lens body. Also, the modular design of NexGen MGS will offer affordable and/or convenient upgrade options.

Another object of an embodiment of the invention is to provide shooters options to install various magnifiers using a flip type mount to convert a machinegun into a sniper weapon. Any magnifier can be quickly attached to the NexGen MGS without using any tools. In addition, the flip type magnifier mount is designed to accommodate night vision, bullet or Eye Piece cameras and other optical devices. By installing a camera on the magnification mount, soldiers can easily convert a machinegun into a corner-shotgun. For this configuration, users need a display to see targets. Typical displays can be an LCD monitor, a Head Mounted Display (HMD), a hand held PDA and others, such as a cell phone, among others.

The NexGen MGS can come with multiple picatinny rails on the lens body allowing users to install a LRF, illuminators, laser pointers and a thermal camera to convert the NexGen MGS truly to a day and night sight.

Another object of an embodiment of the invention is to provide users an option to select the right color reticle. With the Display Module, users can select colors for reticles. Usually, green light is more effective during day light operations.

Another object of an embodiment of the invention is to offer an aerodynamic design sight where foreign debris such as snow, dirt, sand and other objects are prevented from accumulating in front of the DM and obstructing projection of red dot on the lens.

Additional features and advantages of this invention will be set forth in the description which follows, and in part will be apparent from the description, or may be learned by practice of this invention. The objectives and other advantages of this invention will be realized and attained by the structure partially pointed out in the written description and claims thereof as well as the appended drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Hereinafter, example embodiments of this invention will be described in detail with reference to FIGS. 1-9. Like references numerals designated like elements thought the specification.

Figure 1:
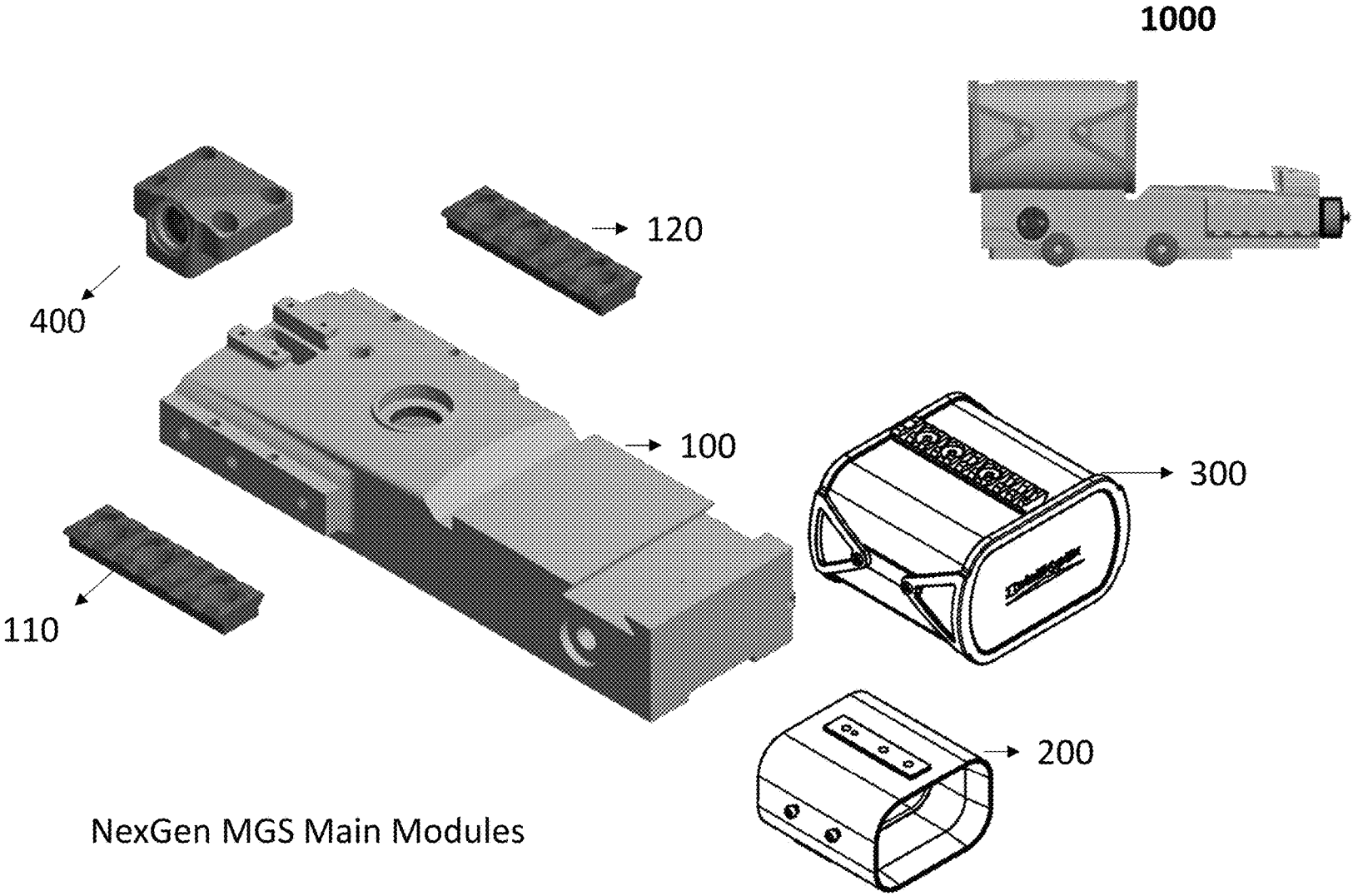
FIG. 1 shows main components (modules) of a NexGen Machine Gun Sight (NexGen MGS) with a Main Body, Lens Bodies (Medium and Large), Rails, and a Display Module, among others, according to an example embodiment of the invention.

FIG. 1 shows a modular design NexGen MGS 1000 according to an example embodiment of the invention. Main components of the NexGen MGS 1000 according to all embodiments of the invention are operationally coupled and configured. The NexGen MGS according to an example embodiment includes a main body 100, a lens body, being either a medium size 200 or a large size 300, Rails, such as a left side rail 120 and a right side rail 110, and a Display module 400. The left and right side rails 120 and 110 can be picatinny rails.

Figure 2:
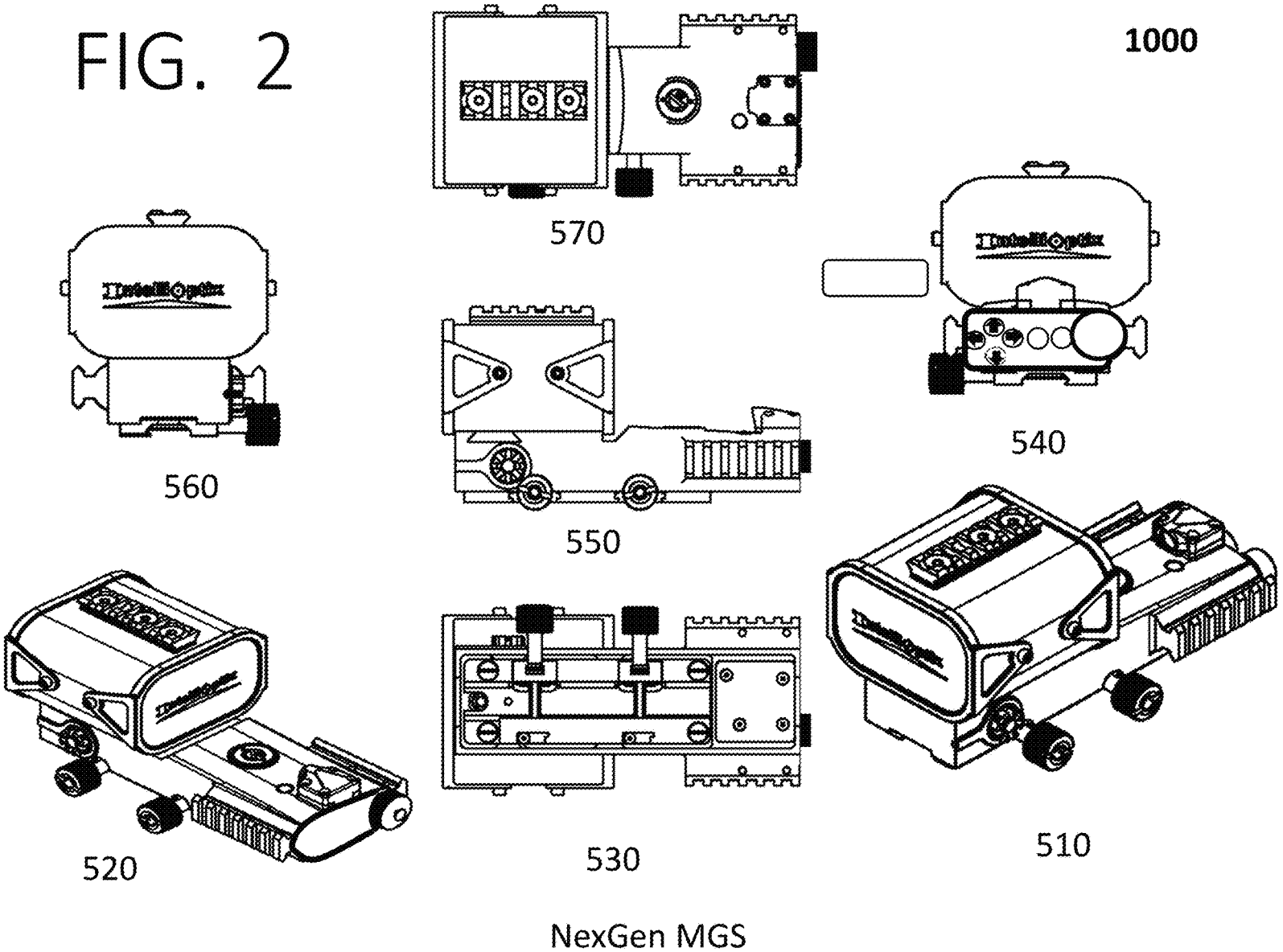
FIG. 2 shows different views of the NexGen MGS according to an example embodiment of the invention.

FIG. 2 shows a perspective views of a right/front 510 side of the NexGen MGS 1000, a perspective view of a right/back side 520 of the NexGen MGS 1000, a bottom plan view 530 of the NexGen MGS 1000, a back view 540 of the NexGen MGS 1000, a right-side view 550 of the NexGen MGS 1000, a frontal view 560 of the NexGen MGS 1000, and a top plan view 570 of the NexGen MGS 1000.

Figure 3:
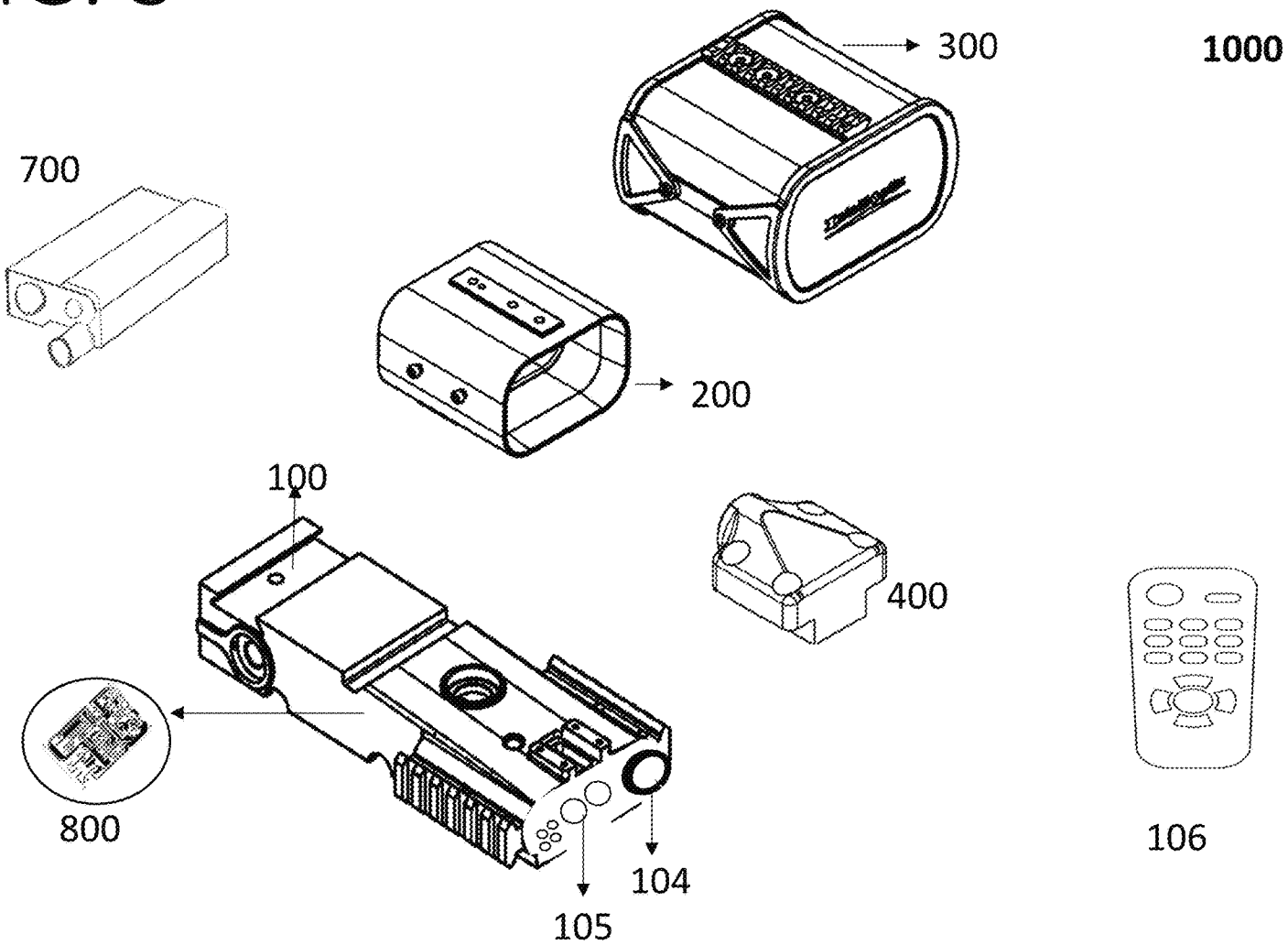
FIG. 3 shows the NexGen MGS with other modules such as Laser Ranger Finder (internal), Ballistic Computer (built-in) and Remote Control according to another example embodiment of the invention.

FIG. 3 shows main modules of a NexGen MGS 1000 according to an example embodiment of the invention. The NexGen MGS 1000 according to an example embodiment includes a main body 100 with a control switch 105 and a battery or a battery compartment 104, a lens body either a medium size 200 or a large size 300, a Display Module (DM) 400, a Laser Range Finder (LRF) 700 as a standalone or integrated to the NexGen MGS 1000, a Ballistic Computer 800 integrated into the NexGen MGS 1000, and a remote control 106. The Ballistic Computer 800 is the brain of the NexGen MGS 1000 where reticles/disturbed reticle, other range related information is calculated/generated so that the Display Module can project them to the Lens 250. The LRF is a weapon-mounted, battery operated laser rangefinder with integrated infrared (IR) illumination and aiming lasers (IR and variable), and a Digital Magnetic Compass (DMC). When operated in conjunction with a GPS, the DM 400 can be used to display target location as geo-spatial coordinates (grid or slant). The NexGen MGS is designed to work with various military LRFs and a LRF is directly connected to the Ballistic Computer 800. The control switch 105 can include buttons, dials, or other mechanisms to control display or main menu of information by the DM 400.

The NexGen MGS 1000 is designed and developed primarily for crew-served weapons. The NexGen MGS 1000 provides crew-served weapon operators improved probability of hit capabilities out to the maximum effective range of the weapon. A design of the NexGen MGS 1000 allows for quick target acquisition and simplifies the shooting process (e.g., point and shoot). The NexGen MGS 1000 with a very large FOV enables significantly reduced target acquisition time, improved situational awareness, and improved accuracy helps to relieve collateral damage concerns. With extra wide field of view, the NexGen MGS 1000 offers both-eyes-open shooting both stationary and moving targets with superior situational awareness. The NexGen MGS 1000 offers shooters a pinpoint accuracy and enhances the shooter's confidence that a target will be hit every time.

Figure 4A:
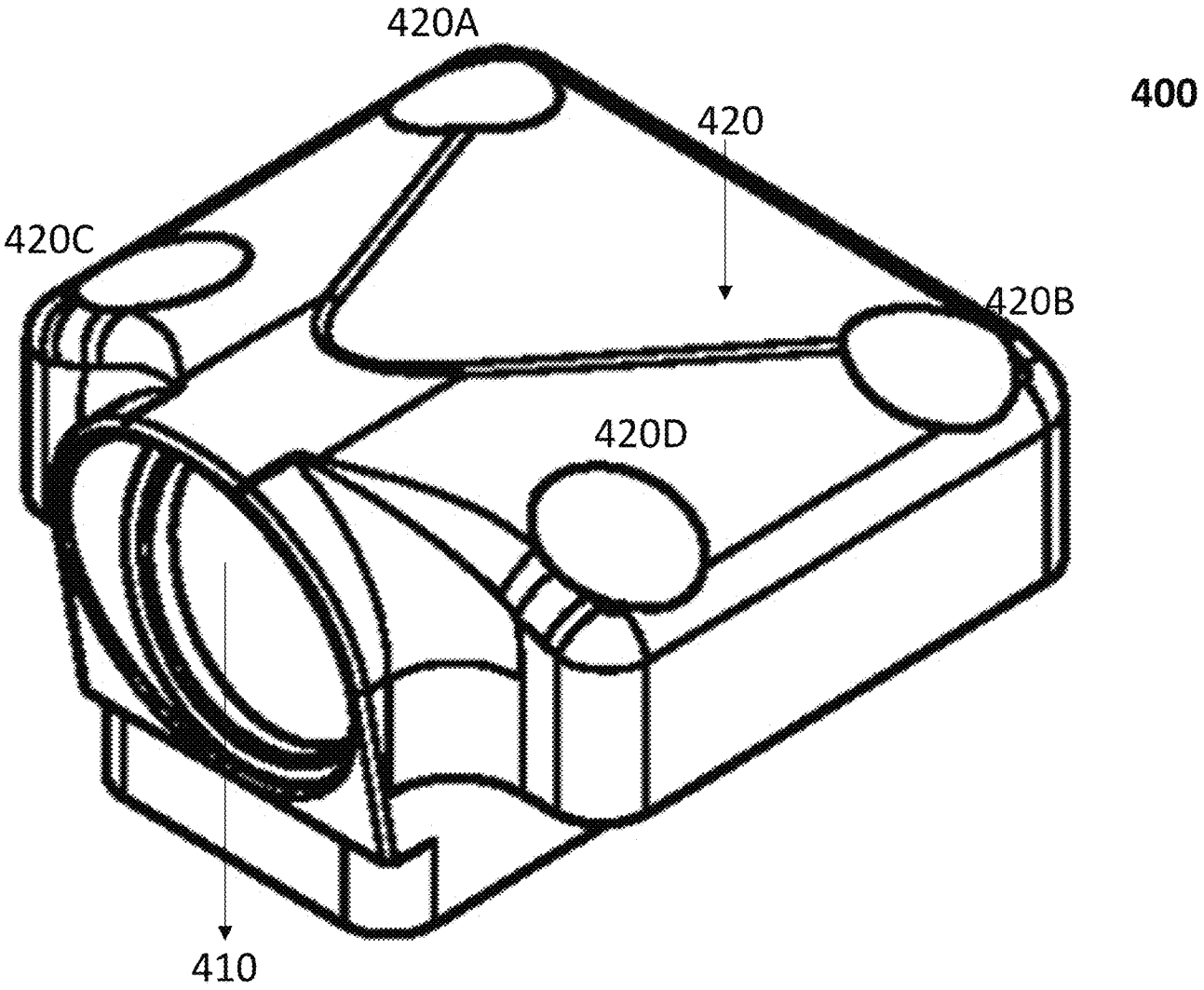
FIG. 4A shows a perspective view of a Display Module according to an example embodiment of the invention.

FIG. 4A shows a perspective view of the DM 400 having a main body 420 with one or more holes, such as 4 holes 420A, 420B, 420C and 420D, to install the DM 400 to the NexGen MGS 1000. The DM 400 is designed so that users can quickly and easily replace the display module 400 in case of failure or during routine maintenance.

Figure 4B:
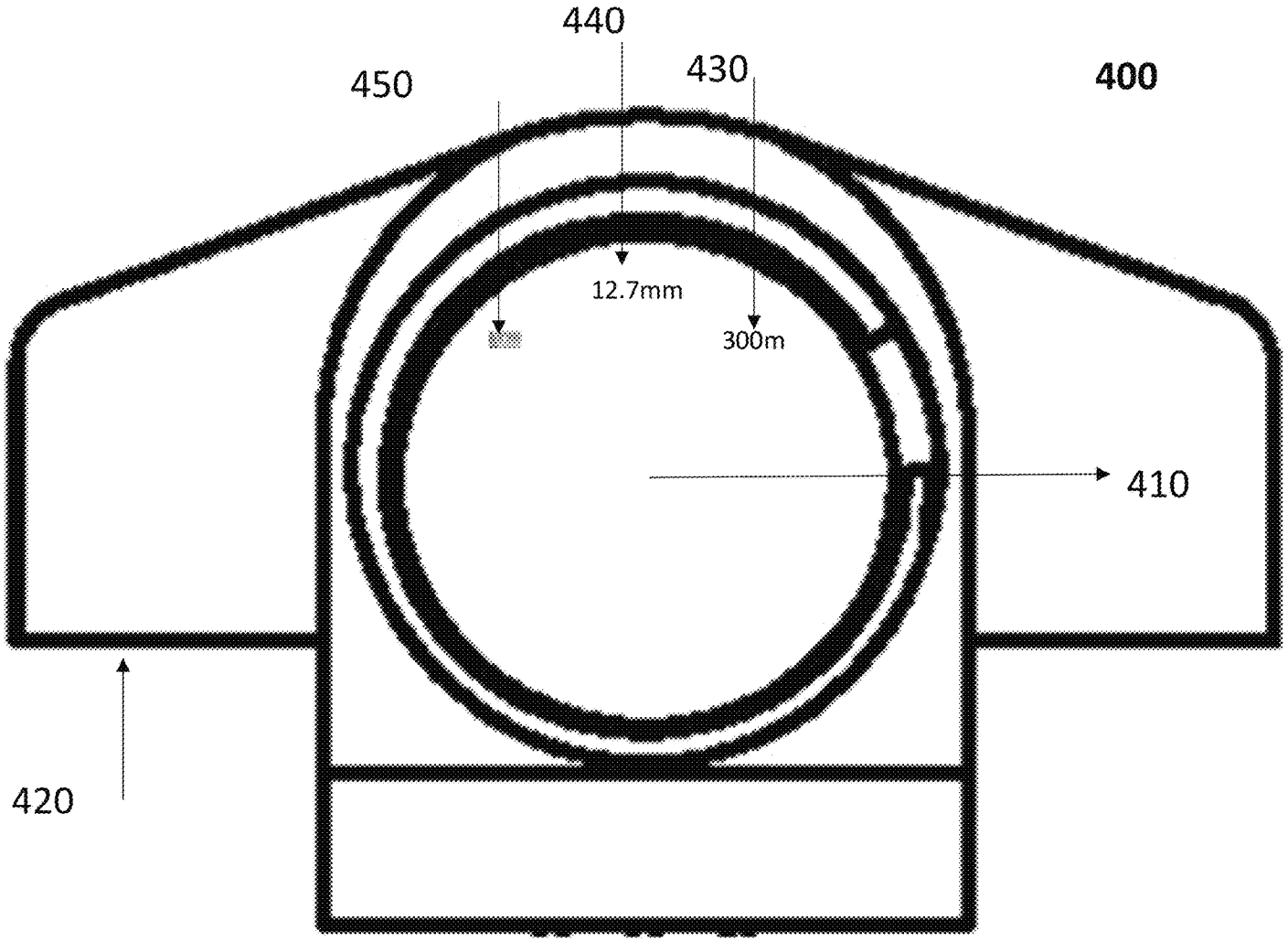
FIG. 4B shows a front view of the Display Module according to an example embodiment of the invention.

FIG. 4B shows a frontal plan view of the DM 400 and it can accommodate any high resolution/sunlight readable display 410 such as an OLED display, a transparent display, and a LCD display, such as a high-resolution LCD display.

Figure 4C:
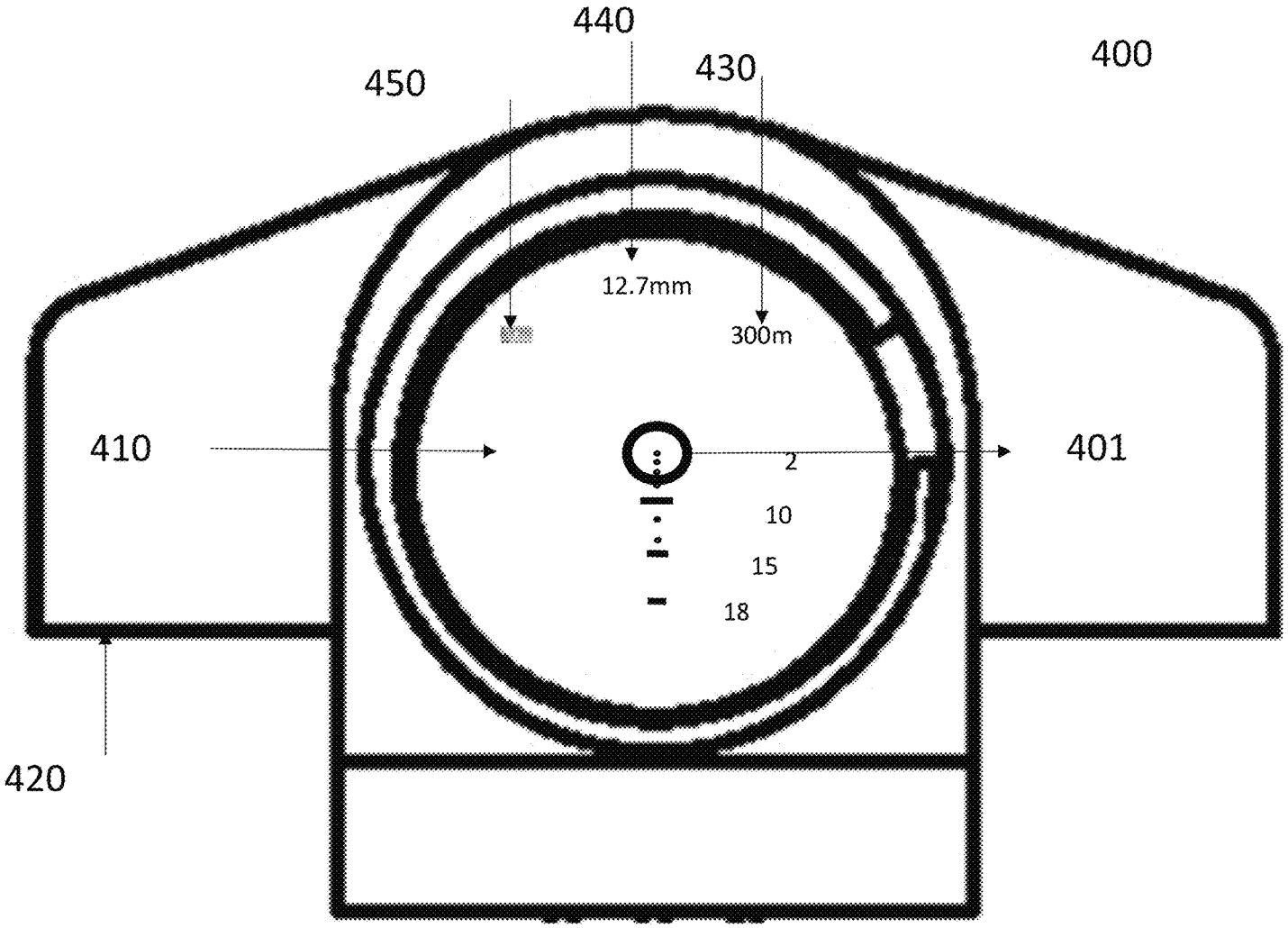
FIG. 4C shows a front view of the Display Module with a MIL DOT CIRCLE reticle according to an example embodiment of the invention.

FIG. 4C shows a frontal view of the DM 400 showing a reticle 401 (such as a MIL DOT CIRCLE reticle). Using the latest OLED or transparent technologies, the NexGen MGS 1000 can generate/project multiple reticles (5.56 mm, 7.62 mm, 12.7 mm, 30 mm and others). Also, DM 400 can generate and project other valuable information such as a distance to a target (range) 430 when the NexGen MGS 1000 is connected to a LRF 700, Caliber type 440 and battery status 450. Other information can be displayed using numeral, icons, symbols, or other indicia.

Figure 4D:
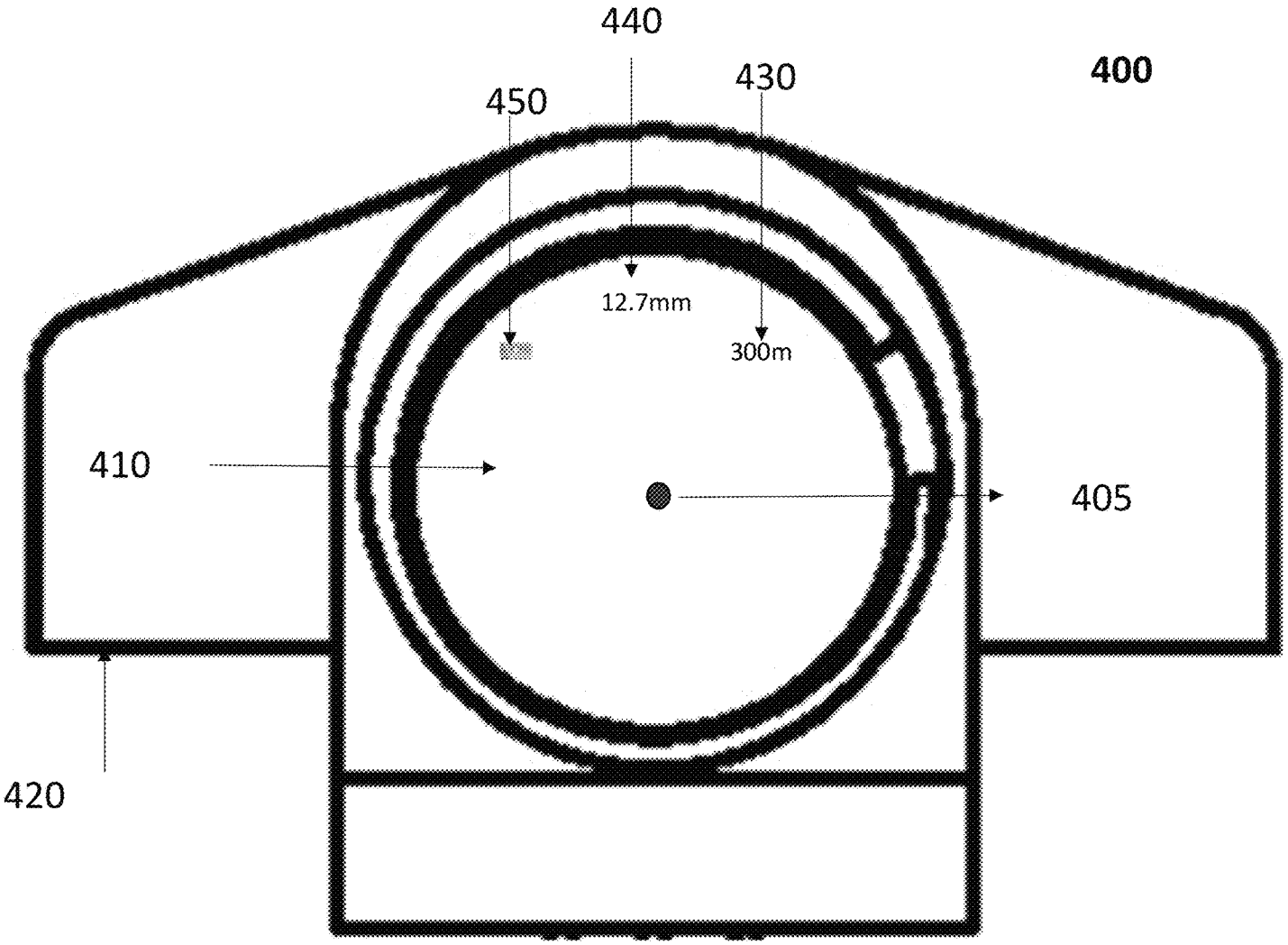
FIG. 4D shows a front view of the Display Module with a disturbed reticle according to an example embodiment of the invention.

FIG. 4D shows a frontal view of the display module 400 showing a disturbed reticle 405. LRFs used by military or law enforcement agencies can be plug into the NexGen MGS 1000 to acquire accurate distance to a target. The NexGen MGS 1000 can automatically calculate a bullet drop when a LRF 700 is connected to the Ballistic computer 800 offering to deliver the first round on target. The NexGen MGS's disturbed reticle 405 provides a range-adjusted aiming point based on ballistic equation or solution embedded within the sight and eliminating guesswork.

As shown in FIGS. 4A-4D, the DM 400 is able to provide a disturbed reticle that provides a range-adjusted aiming point based on ballistics equations embedded within the Sight. The reticles are compatible with all the weapon and ammunition combinations. The reticles are a user selectable disturbed reticle color. Color choices can be red or green, other colors, and can be usable with embedded ballistics equations based upon the firing tables for the weapon and ammunition combinations.

The Ballistic computer is a solid state electronic module with a small form factor for an easy integration into the NexGen MGS. The ballistic computer is designed to get you close to target as there are many variables that go into shooting machineguns effectively. The ballistic computer is also designed to accept one or more external data, execute highly complex calculations and give shooters increased probability of hits. In General, BDC reticles offer a generalization of bullet trajectory and can only estimate bullet drop in a specific scenario as there are many other factors that determine a bullet's flight trajectory. When sensors are connected to the ballistic computer, they measure wind speed, air temperature, barometric pressure, bore line angle and other environmental information, and provide an exact distance at which the bullet will hit. To get the best performance out of the NexGen MGS, the ballistic computer can be an integral part of the NexGen MGS and can be directly connected to a LRF for maximum accuracy. The ballistic computer is able provide ranging outputs, including Range to Target (Unit options include Yards and Meters distances), Elevation Adjustment (Displayed in MOA, Mils, Inches or Clicks), Windage Adjustment (Displayed in MOA, Mils, Inches or Clicks). The ballistic computer allows users to stay focused on the mission while it handles the ballistic solution. The ballistic computer supports multiple protocols to drive or support the DM. Users are able to add other ballistic tables to the NexGen MGS's ballistic computer quickly or easily by upload, download, or manually via a port or by network or Bluetooth, for example.

Figure 5:
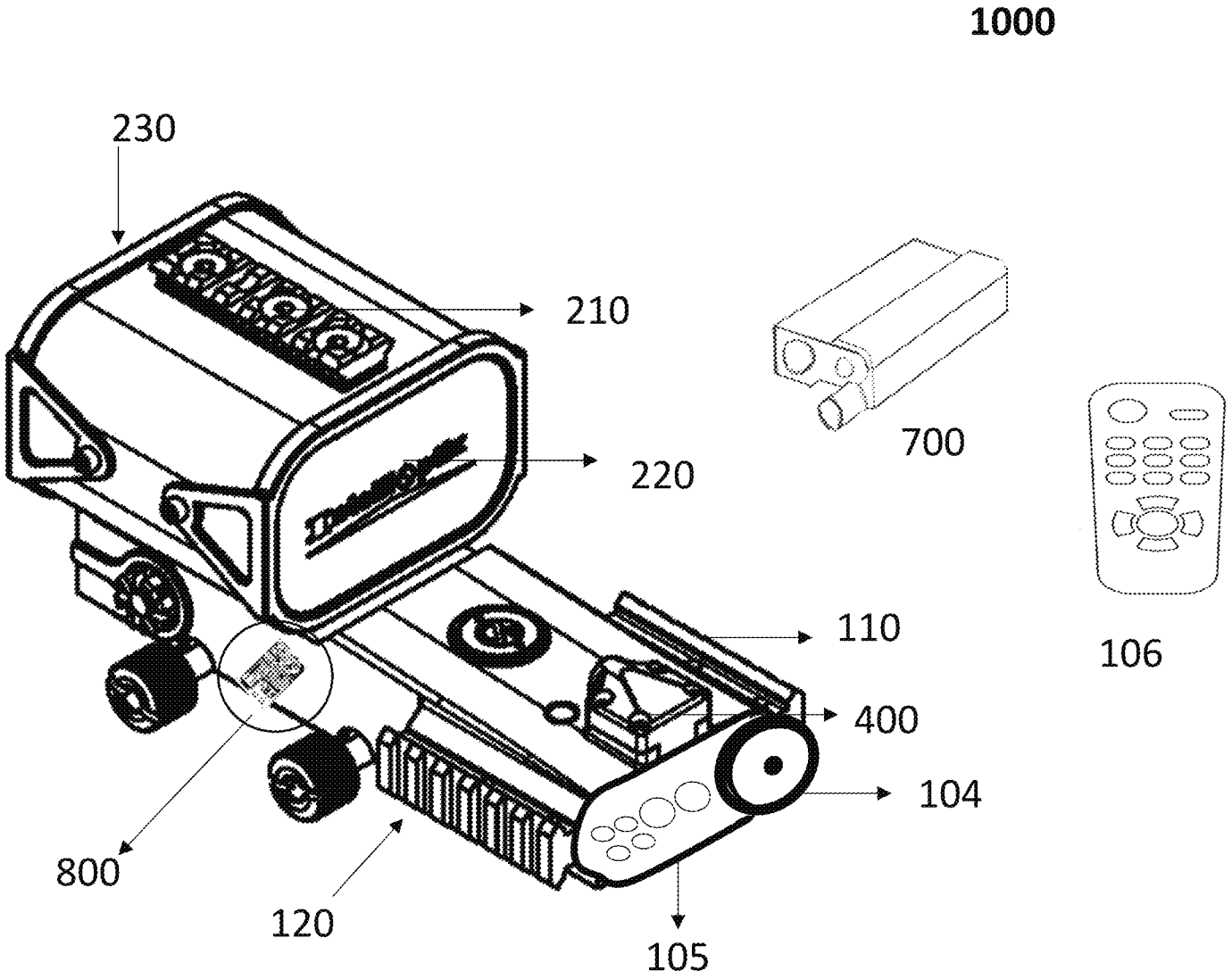
FIG. 5 shows a perspective view of the NexGen MGS with a laser range finder, a Ballistic Computer (built-in) and a remote control according to an example embodiment of the invention.

FIG. 5 shows a prospective view of the NexGen MGS 1000 with a LRF 700 according to an example embodiment of the invention. Any commonly used LRF can be plugged into the NexGen MGS's ballistic computer 800 using one or more picatinny rails, including a right side rail 110 or a left side rail 120. The NextGen MGS 1000 can be operated using a touch control switch 105 facing the shooter or a remote control 106. To protect the sight lens, the NexGen MGS 1000 can include the lens body with a flip type front lens cover 230 and back lens cover 220. A picatinny rail 210 can be disposed on the lens body.

Figure 6:
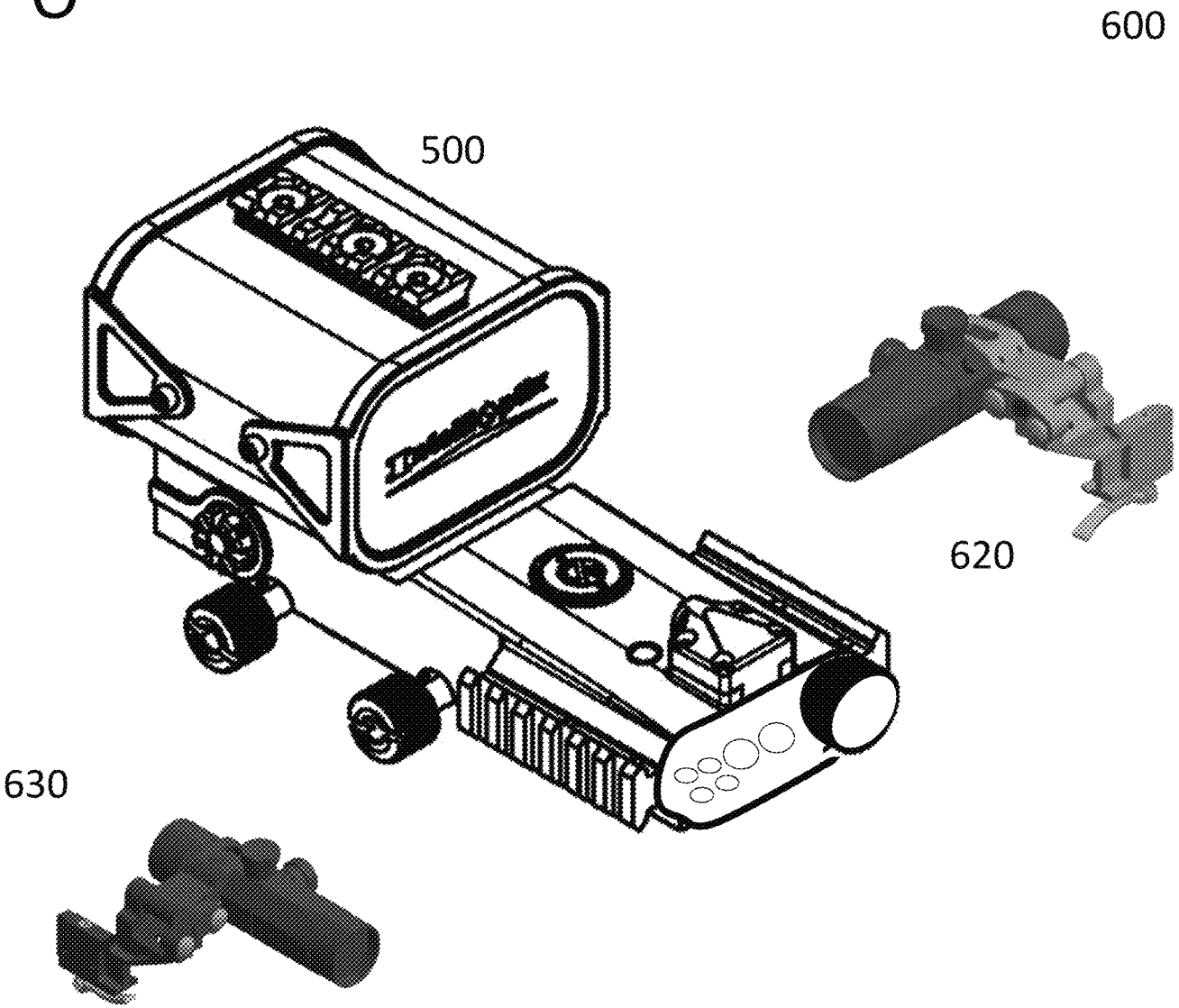
FIG. 6 shows a perspective view of the NexGen MGS with various magnifiers according to an example embodiment of the invention.

FIG. 6 shows a prospective view of the NexGen MGS 1000 with magnifiers 620 and 630 according to an example embodiment of the invention. The NexGen MGS 1000 can be used with multiple magnifiers or magnification mounts 620 and 630 so that users can configure the NexGen MGS 1000 to meet their specific missions. A right side magnification mount 620 is specifically designed to accommodate right hand shooters. The left side magnification mount 630 is specifically designed to accommodate left hand shooters. In addition, other military accessories/equipment can be attached to the NexGen MGS 1000 such as NVGs, cameras and others. Using a magnifier, shooters can identify and recognize targets prior to a shooting reducing collateral damages.

Figure 7:
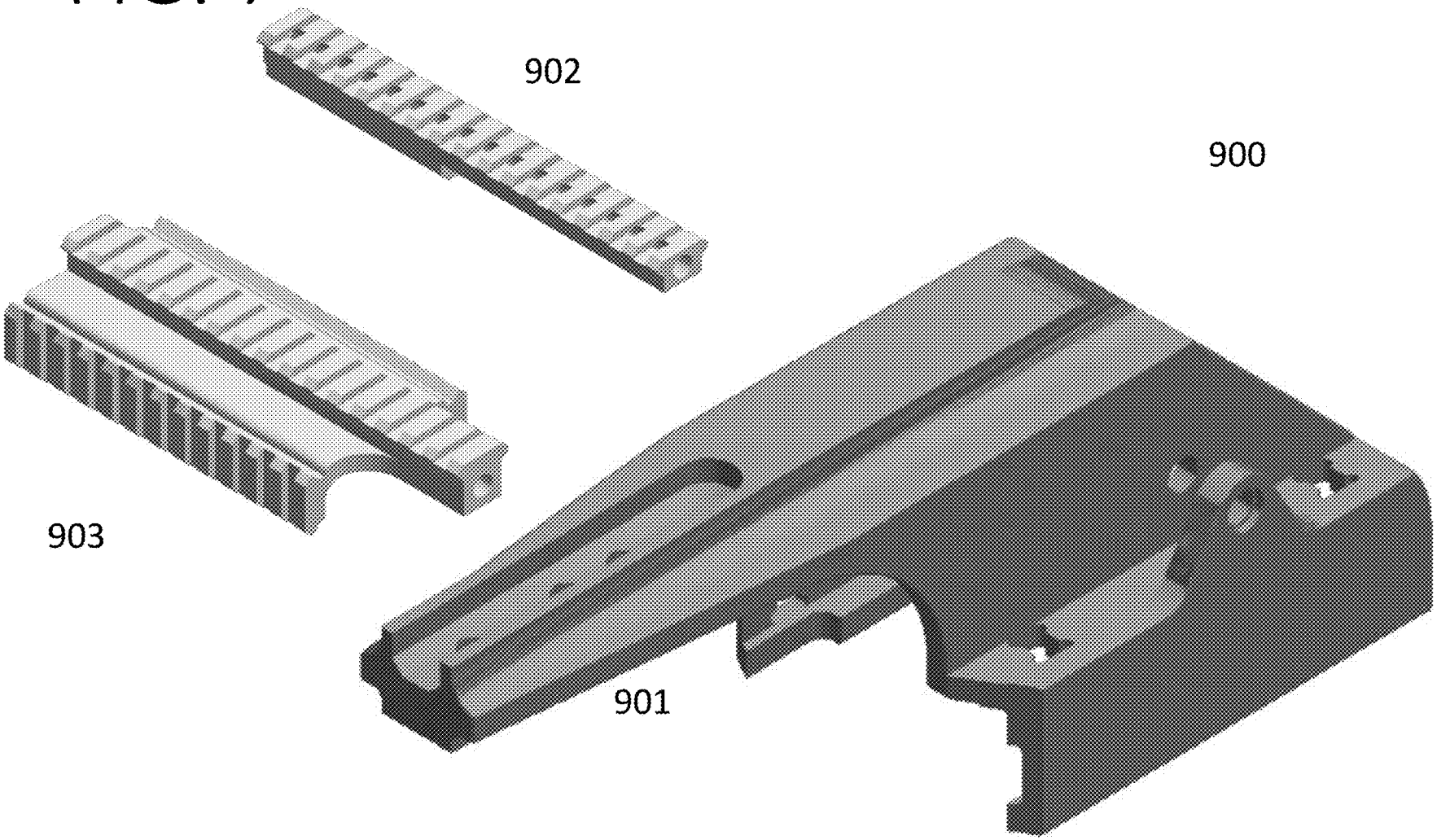
FIG. 7 shows a perspective view of a Modular M2 Mount with a single and tri rails according to an example embodiment of the invention.

FIG. 7 shows a prospective view of a Modular M2 Mount 900 with a single rail 902 and tri rails 903 according to an example embodiment of the invention. Using the Tri rail 903, users have an option to install a LRF or other equipment. The M2 mount 900 can be used to install the NexGen MGS 1000 to a .50 caliber machinegun, for example. Other mounts to install the NexGen MGS 1000 to other caliber machineguns can be used.

TABLE 1 shows a sample firing table that shooters can use to build their own firing tables when specialty ammo or newly developed ammo is used. Angle of elevation and drift information from ammo supplier can be entered to the ballistic computer allowing users to operate the NexGen MGS 1000 with specialty ammunitions not listed on the NexGen MGS's main menu.

TABLE 1

FIRING TABLE INFORMATION
Weapon: 0.50 Cal
Ammunition M33 Ball (12.7 mm)

| RANGE (m) | ANGLE OF ELEVATION (MIL) | DRIFT (MIL) |
|---|---|---|
| 100 | | |
| 200 | | |
| 300 | | |
| 400 | | |
| 500 | | |
| 600 | | |
| 700 | | |
| 800 | | |
| 900 | | |
| 1000 | | |
| 1100 | | |
| 1200 | | |
| 1300 | | |
| 1400 | | |
| 1500 | | |
| 1600 | | |
| 1700 | | |
| 1800 | | |
| 1900 | | |
| 2000 | | |

Figure 8A:
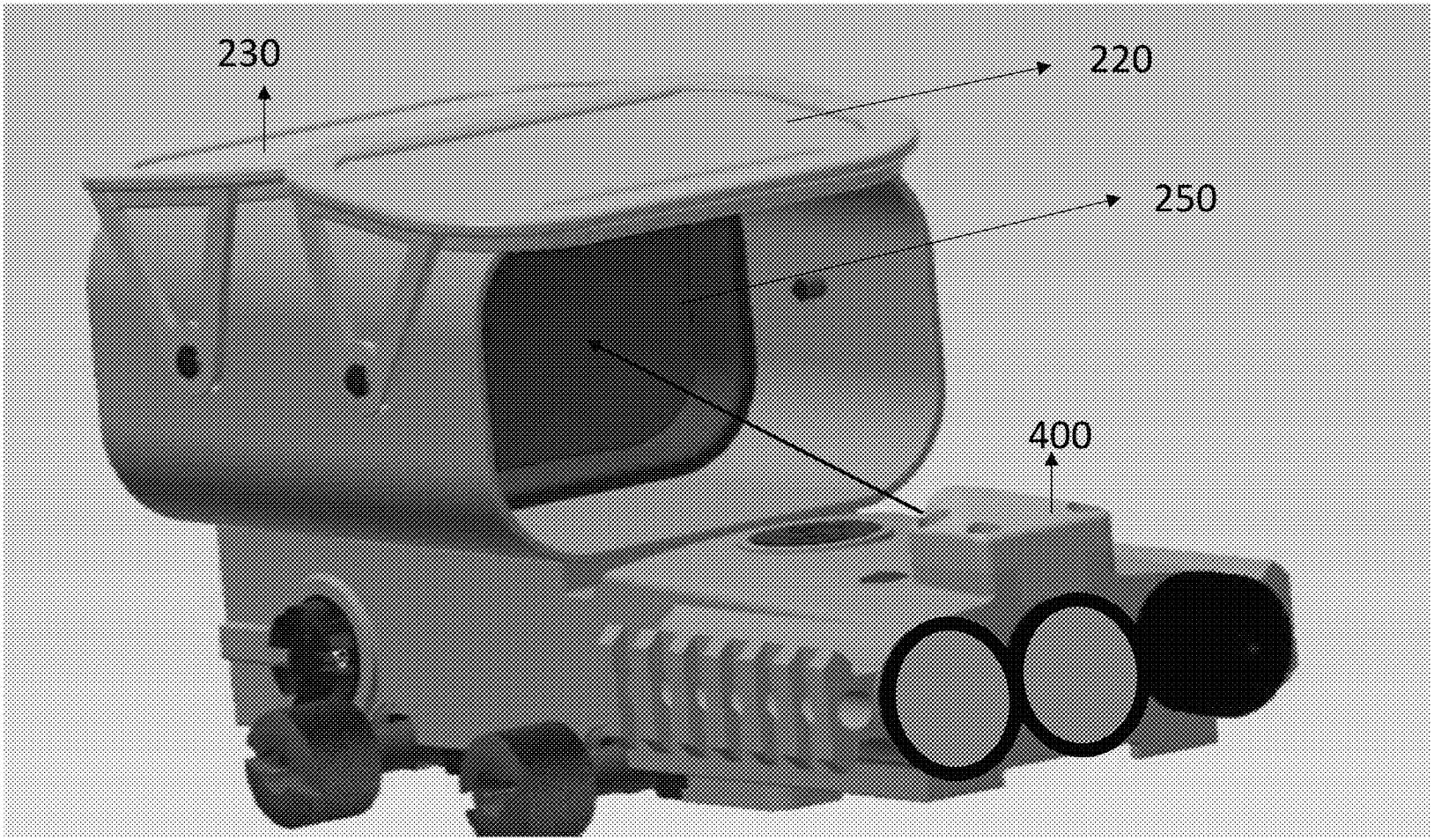
FIG. 8A shows a view of the NexGen MGS being used with the Display Module according to an example embodiment of the invention.

FIG. 8A shows a view of the NexGen MGS being used with the Display Module according to an example embodiment of the invention. The NexGen MGS provides the Display Module 400 that provides an image (e.g., "shoots an image") to a lens 250. The lens 250 of the lens body can be formed of glass or can be a collimating mirror. Information provided by the ballistic computer, including Range to Target (Unit options include Yards and Meters distances), Elevation Adjustment (Displayed in MOA, Mils, Inches or Clicks), Windage Adjustment (Displayed in MOA, Mils, Inches or Clicks), and others, are converted by the Display Module 400 and provided to the lens 250 of the NexGen MGS. The surface 250 of the lens body is protected by the front 230 and the back 220 lens covers.

Figure 8B:
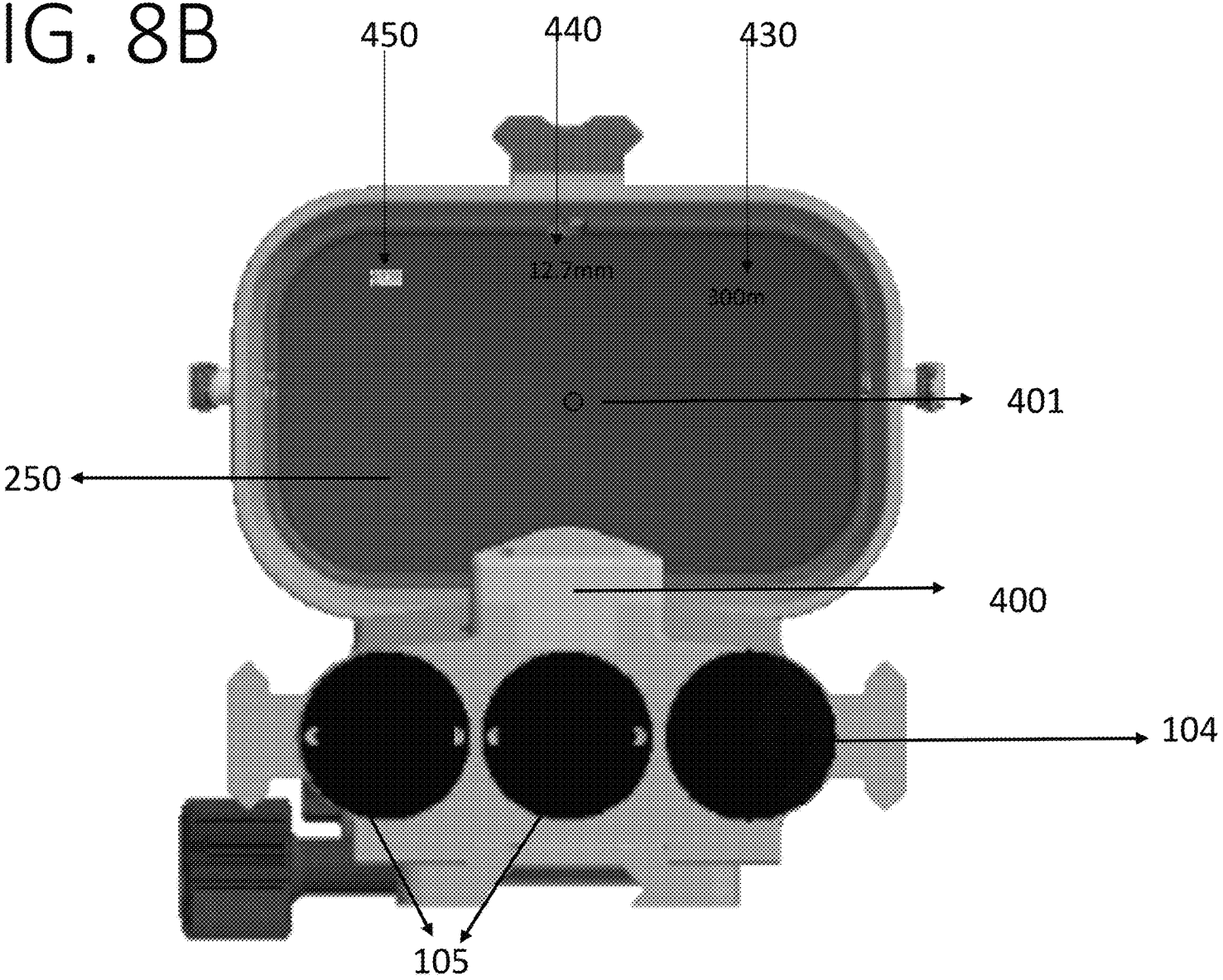
FIG. 8B shows a view of the NexGen MGS when an image from the Display Module is projected on the lens according to an example embodiment of the invention.

FIG. 8B shows a view of the NexGen MGS when an image from the Display Module 400 is provided according to an example embodiment of the invention. As an example, shown in FIG. 8B are a Caliber type 440, a target (range) 430, and a disturbed reticle 401, but other information such as wind, temperature and among others, can be projected/displayed. The Display Module 400 is controlled by control switches 105 and it is powered by commercially available batteries 104.

Figure 9:
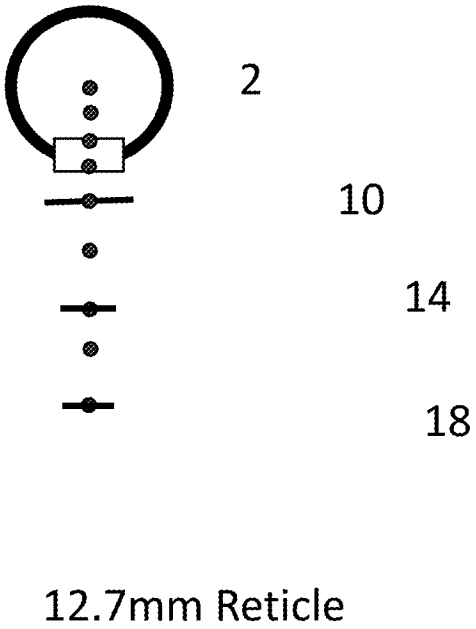
FIG. 9 depicts a sample of a 12.7 mm reticle generated by a built-in ballistic computer according to an example embodiment of the invention.

FIG. 9 depicts a sample of 12.7 mm MIL DOT CIRCLE reticle 401 generated by the Display Module 400 according to an example embodiment of the invention. The Display Module can also generate other reticles such as 7.62 mm, 20 mm and others. An image with elements arranged as depicted in FIG. 9 can be projected on the lens 250 of the NexGen MGS 1000.

According to embodiments of the invention, the NexGen MGS can be a lightweight, rugged, and battery-operated reflex sight for surveillance and target acquisition for all variants of crew served weapons, such as M240, M2, and MK19 during daylight, adverse weather, and most difficult battlefield conditions. A reflex sight can be an optical device that allows a user to look through a partially reflecting glass element and see an illuminated projection of an aiming point or some other image or data superimposed on a field of view.

According to embodiments of the invention, the NexGen MGS can provide an integrated laser range finder (I-LRF) capability. The range generated by the I-LRF can be used to calculate a ballistic solution for a selected weapon and ammunition combination and disturb the reticle aiming point accordingly.

The NexGen MGS comes with a disturbed reticle that provides a range-adjusted aiming point based on ballistic equation or solution embedded within the sight. The NexGen MGS is truly universal crew served weapon sight and a shooter will be able to select a caliber from the NexGen MGS main menu to match their ammunition used. A remote or remote pressure pad will enable a user to switch for faster and safer system operation without sacrificing your combat grip.

The NexGen MGS utilizes the latest laser ranging and ballistic computer technologies to make the NexGen MGS a first reflex with larger field of view sight with a disturbed reticle that provides a range-adjusted aimpoint based on ballistics equations embedded within the sight using a display module instead of etching lens/LED module. It takes the guesswork out of shooting. It provides exact aimpoint for a faster and accurate shooting.

The NexGen MGS allows various firing tables to be included (e.g., 5.56 mm, 7.62 mm, 12.7 mm, and 20 mm) to make it truly universal crew served weapon sight. In addition, users will be able add their own firing tables.

The NexGen MGS comes with a main menu to allow a user to select caliber type to match ammo used. The sight will come with commonly used firing tables allowing users to select the ammo type (caliber) prior to a shooting. The main menu can also be used to select the color and enter other shooting related information.

The NexGen MGS includes a magnification mount, wherein the magnification mount is attached to the sight using the magnification mounting rail. Also, rails can be used to attach cameras and optical devices to the NexGen MGS.

The NexGen MGS includes a front and back lens covers, wherein users can easily and quickly flip them to operate the sight. Covers are provided to protect the lens during non-combat situation.

The NexGen MGS includes a control switch facing the user for a very user-friendly operation. The remote control is provided for a user-friendly operation.

The NexGen MGS is designed to accept other range related information such as wind, temperature, angle, and others to improve the accuracy of the weapon used.

Thus far, exemplary embodiments of the present disclosure have been described in detail with reference to the accompanying drawings. However, the present disclosure is not limited to the exemplary embodiments, and modifications and variations can be made thereto without departing from the technical idea of the present disclosure. Accordingly, the exemplary embodiments described herein are merely illustrative and are not intended to limit the scope of the present disclosure. The technical idea of the present disclosure is not limited by the exemplary embodiments. Therefore, it should be understood that the above-described embodiments are not limiting but illustrative in all aspects. The scope of protection sought by the present disclosure is defined by the appended claims and all equivalents thereof are construed to be within the true scope of the present disclosure.

What is claimed is:

1. A NexGen Machine Gun Sight (NexGen MGS) comprising:

a lens body provided in a detachable manner, the lens body having a front side and a back side;

a display module disposed outside of the lens body at a distance from the back side of the lens body and configured to generate and project a user selected reticle directly on a back surface at the back side of the lens body;

a main body to hold at least the lens body and the display module;

a ballistic computer to calculate a ballistic drop of ammunition; and a laser range finder (LRF) to acquire a distance to a target and to feed the distance into the ballistic computer, wherein the display module includes a body, a display positioned within the body, and at least one hole extending through the body and used to fix the body of the display module to the main body, and wherein the body of the display module protrudes above an upper surface of the main body when fixed to the main body.

2. The NexGen MGS of claim 1, wherein the ballistic computer generates multiple firing tables enabling users to select and match a type of ammunition.

3. The NexGen MGS of claim 1, wherein the ballistic computer is able to receive firing tables via upload, download, or manually.

4. The NexGen MGS of claim 2, wherein the type of ammunition includes at least one of 5.56 mm rounds, 7.62 mm rounds, 12.7 mm rounds and 20 mm rounds.

5. The NexGen MGS of claim 1, wherein the ballistic computer generates a disturbed reticle that provides a range-adjusted aiming point based on a ballistic equation or a range solution embedded within the NexGen MGS.

6. The NexGen MGS of claim 1, further comprising a remote controller or a remote pressure pad switch to control system operation of the NexGen MGS.

7. The NexGen MGS of claim 1, wherein the display module projects a disturbed reticle that provides a range-adjusted aimpoint based on ballistics equations embedded within a view sight.

8. The NexGen MGS of claim 1, wherein the display module generates various MIL DOT CIRCLE reticles to allow the NexGen MGS operate without the LRF, and wherein the various MIL DOT CIRCLE reticles include at least one of 5.56 mm, 7.62 mm, 12.7 mm and 20 mm.

9. The NexGen MGS of claim 1, wherein the display module displays a main menu to allow a user to select a caliber type of the ammunition.

10. The NexGen MGS of claim 9, wherein the main menu enables selecting of a color of the user selected reticle, and enable entry of shooting related information.

11. The NexGen MGS of claim 1, further comprising:

a magnification mount, wherein the magnification mount is attached to the main body using a magnification mounting rail.

12. The NexGen MGS of claim 11, wherein a magnifier is attached to the NexGen MGS using the magnification mounting rail.

13. The NexGen MGS of claim 1, further comprising front and back lens covers on the lens body to protect a lens of the lens body during a non-combat situation.

14. The NexGen MGS of claim 1, further comprising a control switch facing a user for operation of the NexGen MGS during performance of a combat grip.

15. The NexGen MGS of claim 1, further comprising a remote control provided for operation of the NexGen MGS.

16. The NexGen MGS of claim 1, wherein the ballistic computer accepts range related information including wind information, temperature information, and angle information to improve an accuracy of a used weapon.

17. The NexGen MGS of claim 1, wherein the display module includes a sunlight readable display.

18. The NexGen MGS of claim 16, wherein the display module includes at least one of an organic light emitting diode (OLED) display, a liquid crystal display (LCD), and a transparent display.

19. The NexGen MGS of claim 1, wherein the display module generates and projects icons or data corresponding to ballistic information.

20. The NexGen MGS of claim 1, wherein the LRF is one of a standalone LRF or a built-in LRF and is connected to the ballistic computer.

21. The NexGen MGS of claim 1, wherein the ballistic computer generates multiple firing tables enabling users to select and match for a caliber type, an ammunition type, or a combination of both.

22. The NexGen MGS of claim 1, wherein the display module generates various MIL DOT CIRCLE reticles for a caliber type, an ammunition type, or a combination of both.

23. A NexGen Machine Gun Sight (NexGen MGS) comprising:

a lens body provided in a detachable manner, the lens body having a front side and a back side;

a ballistic computer to calculate and generate a disturbed reticle;

a display module disposed outside of the lens body at a distance from the back side of the lens body and configured to receive information from the ballistic computer to project a range-adjusted aiming point in the form of the disturbed reticle directly on a back surface at the back side of the lens body and based on a ballistic equation or a range solution; and a main body to hold at least the lens body and the display module, wherein the ballistic computer generates range or target related information as the information, wherein the display module includes a body, a display positioned within the body, and at least one hole extending through the body and used to fix the body of the display module to the main body, and wherein the body of the display module protrudes above an upper surface of the main body when fixed to the main body.

* * * * *